US008690378B2

(12) United States Patent
Choo et al.

(10) Patent No.: US 8,690,378 B2
(45) Date of Patent: Apr. 8, 2014

(54) FLASHLIGHT BEZEL FOCUS LOCK SYSTEM

(75) Inventors: Kam Fu Choo, Vancouver, WA (US); Gregory David Windom, Portland, OR (US)

(73) Assignee: Coast Cutlery Co., Portland, OR (US)

( * ) Notice: Subject to any disclaimer, the term of this patent is extended or adjusted under 35 U.S.C. 154(b) by 92 days.

(21) Appl. No.: 13/460,511

(22) Filed: Apr. 30, 2012

(65) Prior Publication Data

US 2013/0286639 A1 Oct. 31, 2013

(51) Int. Cl.
*F21L 4/00* (2006.01)

(52) U.S. Cl.
USPC ..... 362/187; 362/188; 362/202; 362/205; 362/418; 362/428

(58) Field of Classification Search
USPC ..... 362/187, 188, 202, 205, 285, 418, 428
See application file for complete search history.

(56) References Cited

U.S. PATENT DOCUMENTS

| | | | | | |
|---|---|---|---|---|---|
| 1,674,650 | A * | 6/1928 | Leser | 362/188 |
| 1,691,989 | A * | 11/1928 | Osean | 362/188 |
| 2,125,038 | A * | 7/1938 | Holihan et al. | 362/188 |
| 2,181,447 | A * | 11/1939 | Ayotte et al. | 362/188 |
| 5,158,358 | A * | 10/1992 | Maglica et al. | 362/206 |
| 5,171,086 | A * | 12/1992 | Baloochi | 362/188 |
| 5,400,227 | A * | 3/1995 | Maglica et al. | 362/206 |
| 5,865,525 | A * | 2/1999 | Kibler et al. | 362/187 |
| 6,547,414 | B2 * | 4/2003 | Steger | 362/188 |
| 6,575,589 | B2 * | 6/2003 | Hisasue et al. | 362/118 |
| 7,140,747 | B2 * | 11/2006 | Yang | 362/202 |
| 7,309,139 | B2 * | 12/2007 | Au et al. | 362/188 |
| 7,510,298 | B2 * | 3/2009 | Au et al. | 362/188 |
| 7,815,336 | B2 * | 10/2010 | Au et al. | 362/188 |
| 8,485,683 | B2 * | 7/2013 | Popper et al. | 362/188 |
| 2005/0168978 | A1 * | 8/2005 | Yang | 362/202 |
| 2006/0056176 | A1 * | 3/2006 | Au et al. | 362/188 |
| 2010/0315805 | A1 * | 12/2010 | Dongpan | 362/157 |
| 2012/0218744 | A1 * | 8/2012 | Popper et al. | 362/184 |
| 2012/0300442 | A1 * | 11/2012 | Popper et al. | 362/184 |

* cited by examiner

*Primary Examiner* — Thomas A Hollweg
(74) *Attorney, Agent, or Firm* — Schwabe, Williamson & Wyatt P.C.

(57) ABSTRACT

Embodiments provide a flashlight with a bezel configured to be moved relative to a body of the flashlight to adjust the focus of the light. A locking assembly may be disposed within the bezel and configured to switch between an unlocked position and a locked position if the bezel is rotated with respect to the body. The locking assembly may include a ring-shaped outer component having first and second curved walls separated by a gap. The locking assembly may further include an inner component coupled with the light assembly, the inner component including a nub configured to be disposed in the gap if the locking assembly is in the unlocked position, and to radially push an outer surface of the outer component against the inner surface of the bezel if the locking assembly is in the locked position.

29 Claims, 7 Drawing Sheets

FLASHLIGHT BEZEL FOCUS LOCK SYSTEM

TECHNICAL FIELD

Embodiments herein relate to the field of flashlights.

BACKGROUND

Flashlights often allow a user to adjust the focus of the light beam emitted by the flashlight. For example, the user may adjust the size and/or intensity of the light beam. In some flashlights, the focus is adjusted by sliding a bezel of the flashlight in and/or out. However, in these flashlights, the focus may be inadvertently changed if the bezel is bumped or pressed against a window or other surface. Additionally, the flashlight is often kept in a holder, such as a holster, sheath, or the user's pocket, and the focus may be inadvertently changed if the flashlight is inserted and/or removed from the holder.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

FIGS. 4A-2D are various views of an inner component of the bezel locking assembly of FIG. 1, including (A) a side view, (B) a top perspective view, (C) a bottom view, and (D) a bottom perspective view;

DETAILED DESCRIPTION OF DISCLOSED EMBODIMENTS

Figure 1:
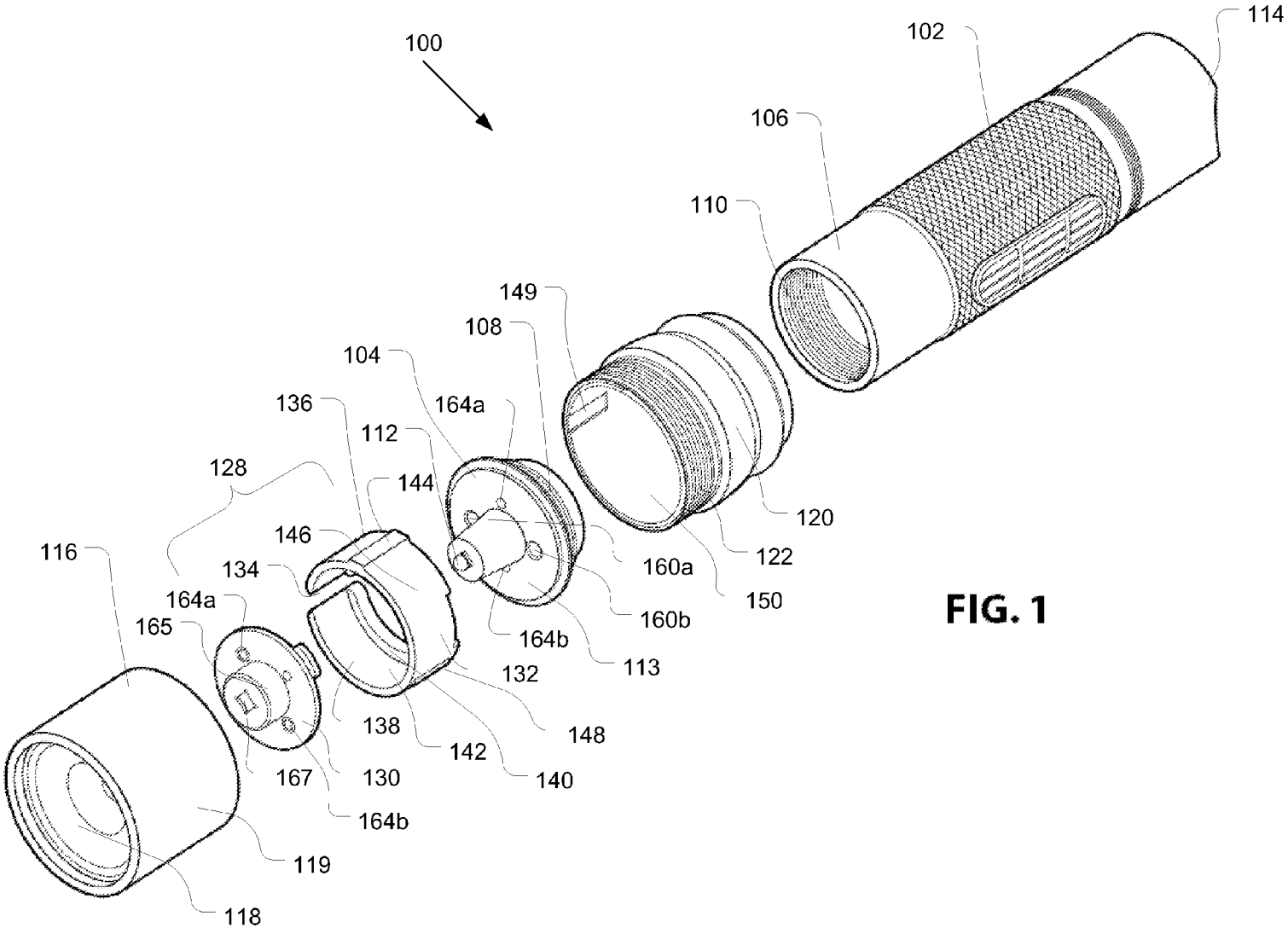
FIG. 1 is an exploded view of a flashlight with a bezel locking assembly in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Embodiments herein provide a bezel locking system for a flashlight. Embodiments provide a flashlight having a body with a light assembly coupled to the first end of the body. The flashlight may further include a bezel coupled to the first end of the body around the light assembly and having a lens configured to focus light from the light source. The bezel may be configured to be moved relative to the body along the longitudinal axis to adjust the focus of the light, and the bezel may be further configured to be rotated with respect to the body in a first direction to lock a current focus position of the bezel. A locking assembly may be disposed within the bezel and configured to switch between an unlocked position and a locked position if the bezel is rotated with respect to the body. The locking assembly may include a ring-shaped outer component having first and second curved walls separated by a gap. The locking assembly may further include an inner component coupled with the light assembly, the inner component including a nub configured to be disposed in the gap if the locking assembly is in the unlocked position, and to radially push an outer surface of the outer component against the inner surface of the bezel if the locking assembly is in the locked position.

As shown in FIG. 1, a flashlight 100 may include a body 102 configured to be grasped by a user. A light assembly 104 may be coupled to a first end 106 of the body 102 (e.g., by threaded portions 108 and 110 of light assembly 104 and body 102, respectively). The light assembly 104 may include a light source 112 coupled to a pedestal 113. In some embodiments, the light source 112 may include a light emitting diode (LED). Although the flashlight 100 is shown with only one LED, other embodiments may include a plurality of LEDs and/or other light sources.

The body 102 may house a battery (not shown) to power the light source 112. A switch (not shown) on a second end 114 of the body 102 may be used to selectively provide power to the light source 112 to turn the light source 112 on and/or off. In other embodiments, the switch may be located in any other suitable location on flashlight 100.

The flashlight 100 may further include a bezel 116 coupled to the first end 106 of the body 102 around the light assembly 104. Bezel 116 may include a focusing lens 118 that may focus the light produced by the light source 112 to form a light beam that is emitted from the flashlight 100. The bezel 116 may be moved with respect to the body 102 of the flashlight 100 (e.g., in a sliding motion along a longitudinal axis of the flashlight 100) to adjust the focus of the light and thereby alter the light beam. For example, adjusting the focus may change the size (e.g., diameter) and/or intensity of the light beam.

Figure 2A:
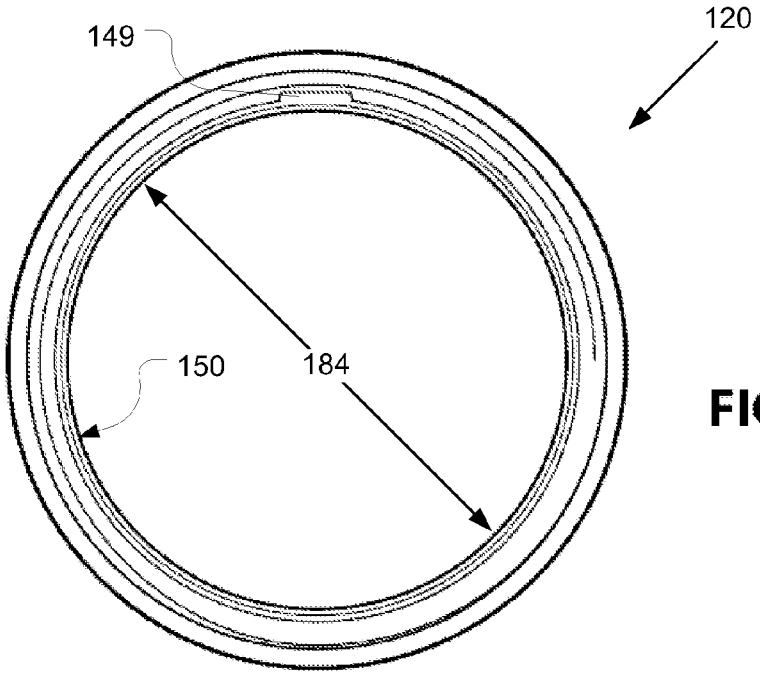
FIG. 2A is a top view of a bottom bezel segment of the flashlight of FIG. 1.
Figure 2B:
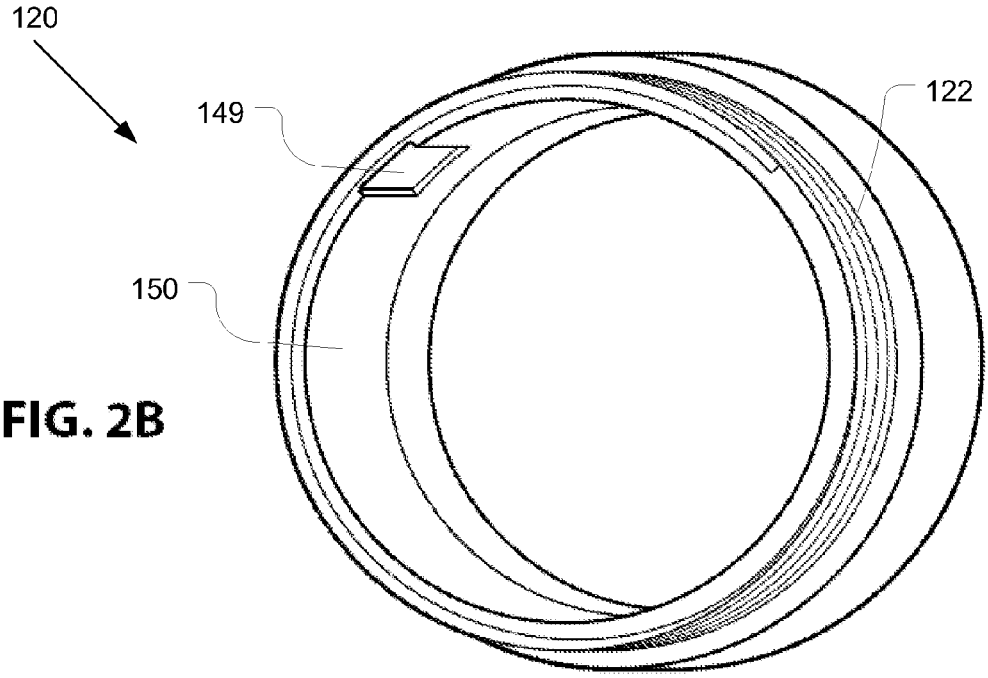
FIG. 2B is a top perspective view of the bottom bezel segment of FIG. 2A.

The bezel 116 may include a top segment 119 and a bottom segment 120 coupled together (e.g., by a threaded portion (not shown) of the top segment 119 and a threaded portion 122 of the bottom segment 120). The light assembly 104 may be generally disposed within a hollow portion 126 of the bottom segment 120. Additional views of the bottom segment 120 of bezel 116 are shown in FIGS. 2A and 2B.

The bezel 116 may be movable between a fully retracted position in which the lens 118 is closest to the light source 112, and a fully extended position in which the lens 118 is furthest from the light source 112, to adjust the focus of the light beam. The light assembly 104 may interact with the bottom segment 120 to prevent the bezel 116 from extending past the fully extended position.

Figure 4A:
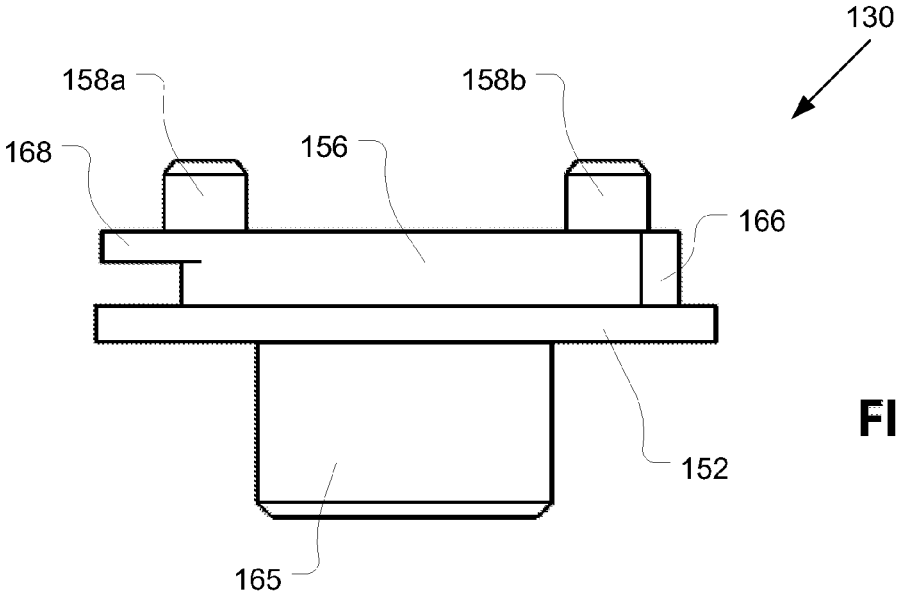
Figure 4B:
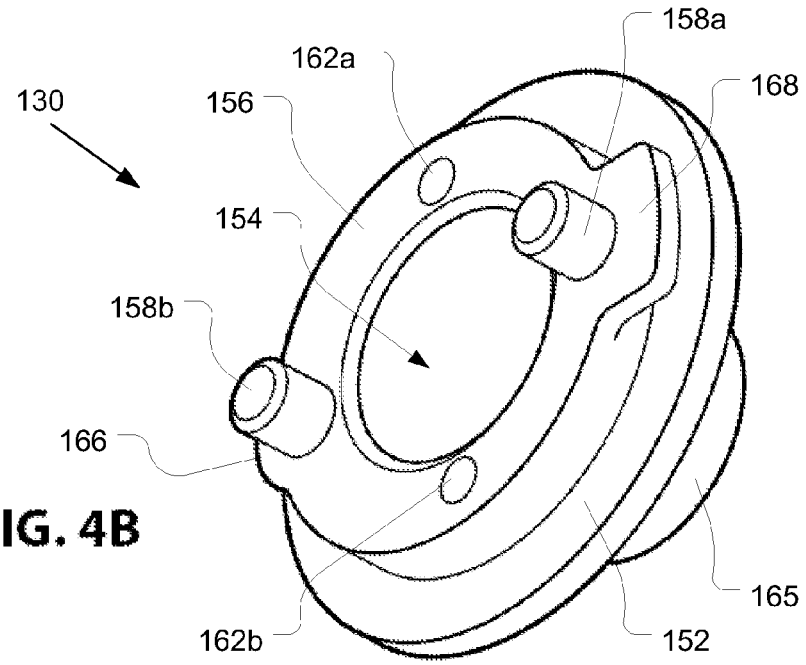
Figure 4C:
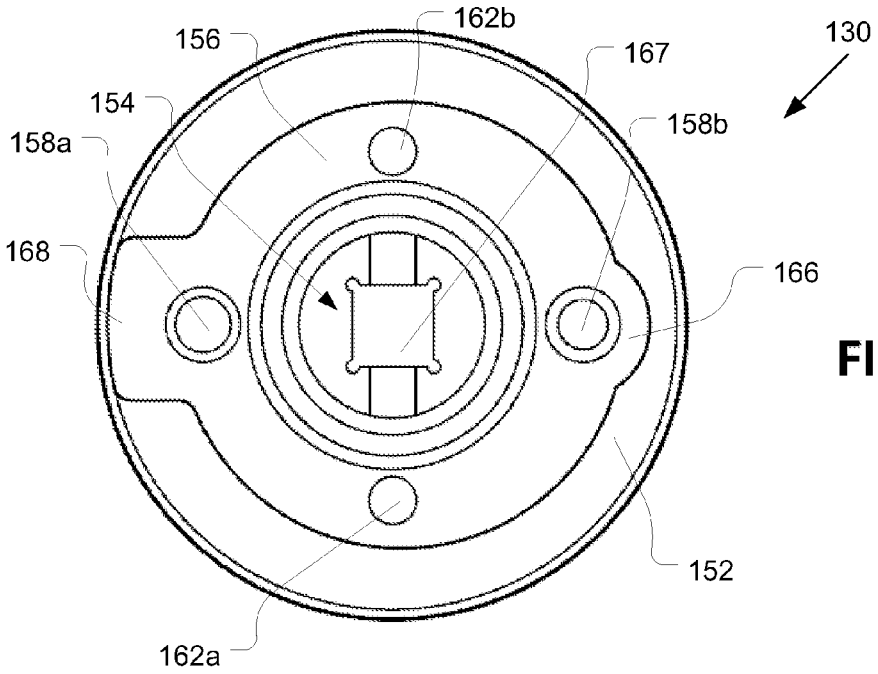
Figure 4D:
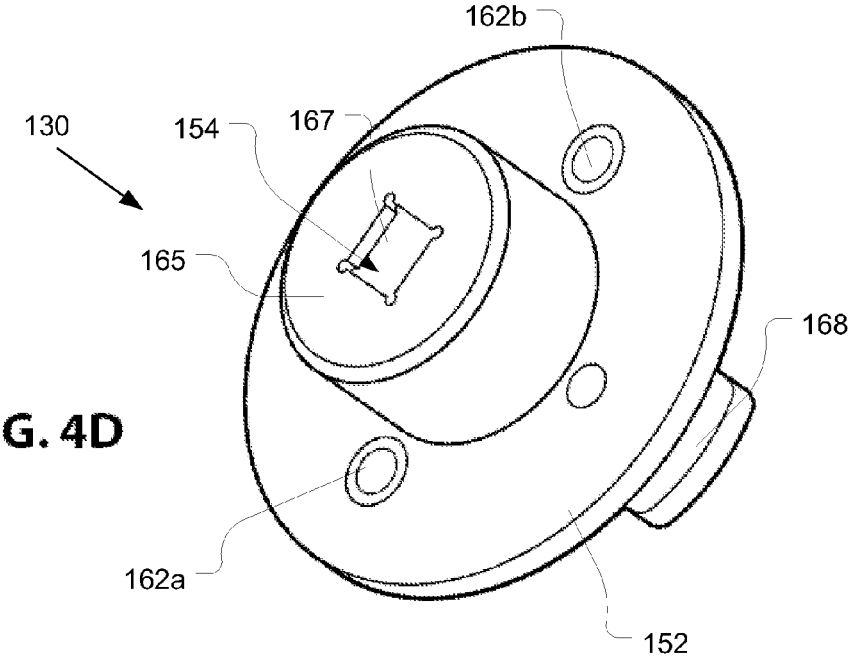
Figure 5A:
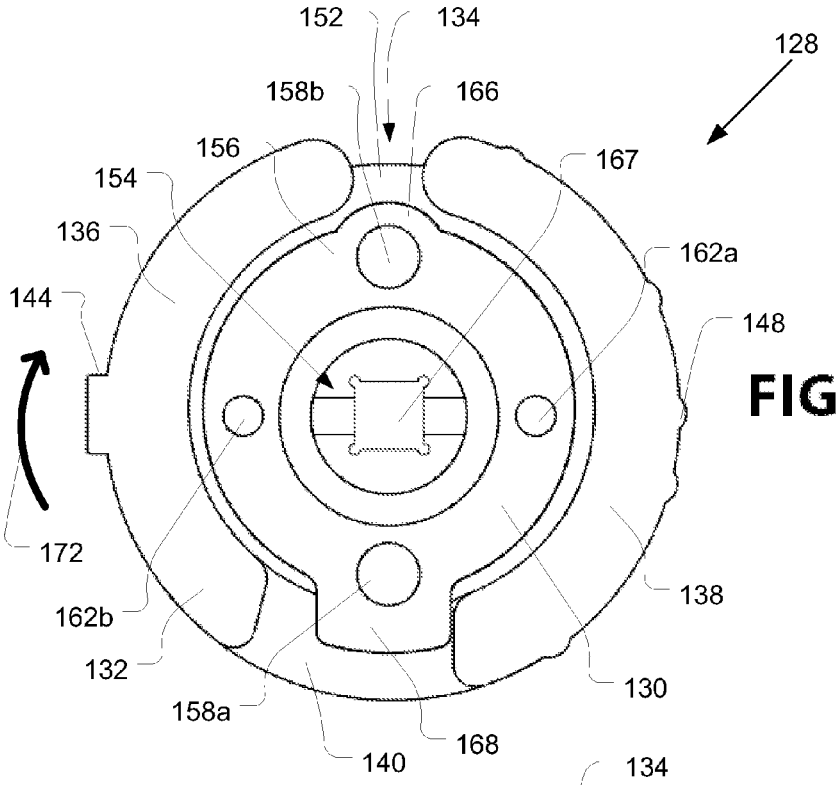
FIG. 5A is a bottom view of the bezel locking assembly of FIG. 1 when the bezel locking assembly is in an unlocked position.
Figure 5B:
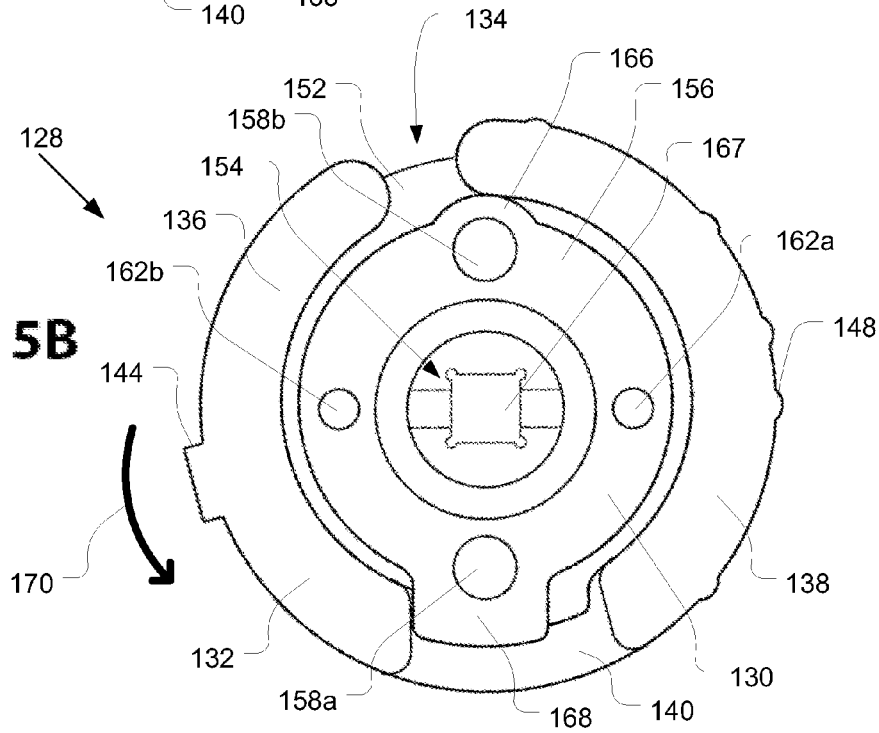
FIG. 5B is a bottom view of the bezel locking assembly of FIG. 1 when the bezel locking assembly is in a locked position.

In various embodiments, the flashlight 100 may include a locking assembly 128 to secure the bezel 116 in a given focus position on the bezel path (e.g., a position between the fully retracted position and fully extended position, inclusive of the endpoints). The locking assembly 128 may include an inner component 130 and an outer component 132. The outer component 132 is further shown in FIGS. 3A-3D, and the inner component 130 is further shown in FIGS. 4A-4D. FIGS. 5A-5B show the inner component 130 coupled with the outer component 132 when the locking assembly 128 is assembled.

As best shown in FIGS. 3A-3D, the outer component 132 may be generally ring-shaped with a gap 134 (e.g., a "C" shape). The gap 134 may separate a first curved wall 136 and a second curved wall 138. A lip 140 may extend from an inner surface 142 of the outer component 132. The first curved wall 136 and second curved wall 138 may be connected on the other side from gap 134 by the lip 140. The first curved wall 136 and second curved wall 138 may both extend above the lip 140. A guide member 144 extends radially from an outer surface 146 of the outer component 132 (e.g., on the first curved wall 136). The outer component 132 may further include ridges 148 on the outer surface 146 (e.g., on the second curved wall 138). Ridges 148 may be generally circumferentially aligned, as shown in FIGS. 3A-3D. Other embodiments may include any other suitable arrangement of ridges 148 and/or other surface elements.

The bottom segment 120 of bezel 116 may include a slot 149 extending for a portion of the axial length of an inside surface 150, as best seen in FIGS. 2A-2B. The guide member 144 of the outer component 132 may slide into and interact with the slot 149 to cause the outer component 132 to rotate with the bezel 116.

As best shown in FIGS. 4A-4D, the inner component 130 may include a disc 152 with a hollow portion 154. A ring 156 may extend from the disc 152, with the ring 156 having a smaller outer diameter than the disc 152. A pair of pins 158*a-b* may extend axially from the ring 156 and through receiving holes 160*a-b* in the light assembly 104 (as seen in FIG. 1). The inner component 130 may be further coupled to the light assembly 104 by screws inserted through screw holes 162*a-b* in inner component 130 and corresponding screw holes 164*a-b* in light assembly 104. Accordingly, the inner component 130 may be prevented from rotating with bezel 116 by pins 158*a-b* and/or the screws in screw holes 162*a-b*.

Inner component 130 may further include a nub 166 that extends radially from ring 156. Nub 166 may be a rounded protrusion as best seen in FIGS. 4A-2C. In other embodiments, nub 166 may have any other suitable structure. Inner component 130 may also include a tab 168 extending radially from ring 156. In the depicted embodiment the tab 168 is offset by 180 degrees from the nub 166. The tab 168 may be axially spaced from disc 152. In some embodiments, tab 166 may be generally parallel with disc 152, as best seen in FIG. 4A.

Inner component 130 may further include a hollow cylinder 165 extending from disc 152 opposite but coaxial with the ring 156. The light source 112 may be disposed in cylinder 165. The cylinder 165 may include an opening 167 through which light from light source 112 may pass. In some embodiments, the light source 112 may extend through the opening 167 when flashlight 100 is assembled.

When the locking assembly 128 is assembled and in the unlocked position, as shown in FIG. 5A, the tab 168 of inner component 130 rests on the lip 140 of the outer component 132 between the first curved wall 136 and the second curved wall 138. The nub 166 of inner component 130 may be aligned with the gap 134 in outer component 132.

In use, the user may rotate the bezel 116 of flashlight 100 in a first direction 170 to place the locking assembly 128 in the locked position, as shown in FIG. 5B. The outer component 132 may rotate with the bezel 116 because of the interaction of guide member 144 with slot 149. However, the inner component 130 may not rotate with bezel 116, since the inner component is secured to the light assembly 104 (which is in turn coupled with the body 102). Thus, the outer component 132 may rotate with respect to the inner component 130, causing nub 166 to push on the second curved wall 138 of the outer component 132 (e.g., at the end of the second curved wall 138 adjacent the gap 134). The second curved wall may be forced outward (e.g., radially), pressing ridges 148 against the inside surface 150 of the bottom segment 120 of bezel 116. The outward force and/or friction caused by ridges 146 on the inside surface 150 may prevent the bezel 116 from being moved axially, thereby locking the focus position of the bezel 116 in place.

The tab 168 may be adjacent the first curved wall 136 in the locked position, thereby preventing the bezel 116 and/or outer component 132 from being rotated past the locked position in the first direction 170.

The focus position may be unlocked by rotating the bezel 116 in a second direction 172, opposite the first direction 170. This may cause the locking assembly 128 to move back to the unlocked position, as shown in FIG. 5A. The tab 168 may be adjacent the second curved wall 138 in the unlocked position, thereby preventing the bezel 116 and/or outer component 132 from being rotated past the unlocked position in the second direction 172.

In various embodiments, the inner component 130 and outer component 132 of the locking assembly 128 may be made of any suitable materials, such as plastic and/or metal. The outer component 132 may be made of one or more suitable materials to allow the second curved wall 138 to be repeatedly pushed outward to place the locking assembly 128 in the locked position, and return inward to return the locking assembly 128 to the unlocked position.

Figure 3A:
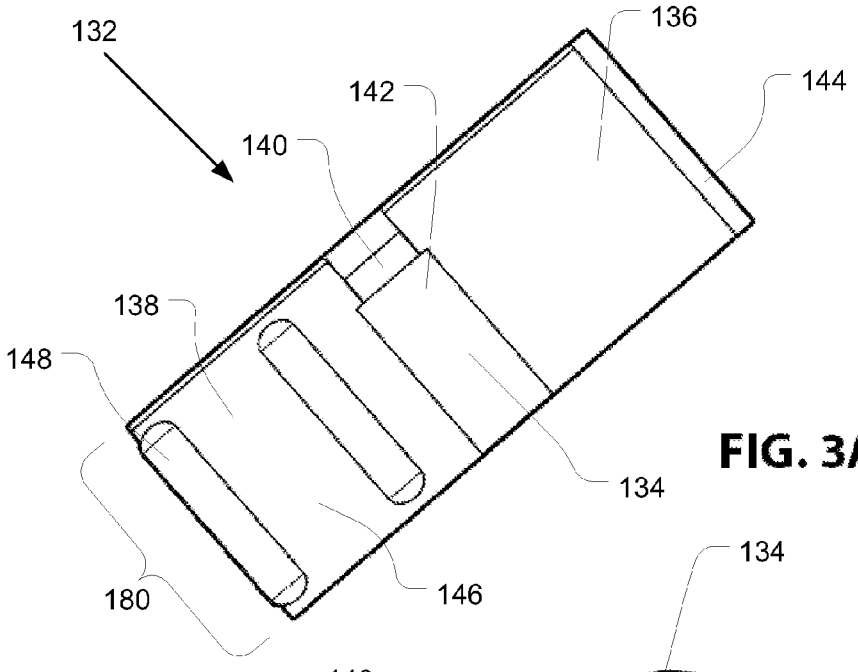
FIGS. 3A-3D is an outer component of the bezel locking assembly of FIG. 1, including (A) a side view, (B) a top perspective view, (C) a bottom view, and (D) another top perspective view.
Figure 3B:
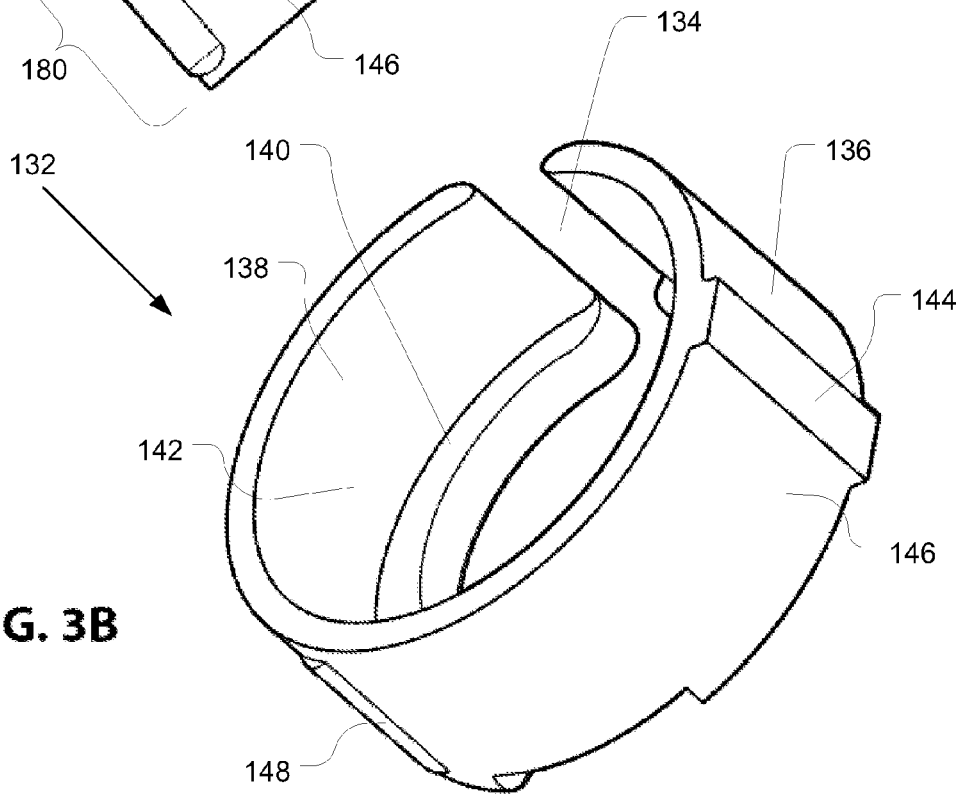
Figure 3C:
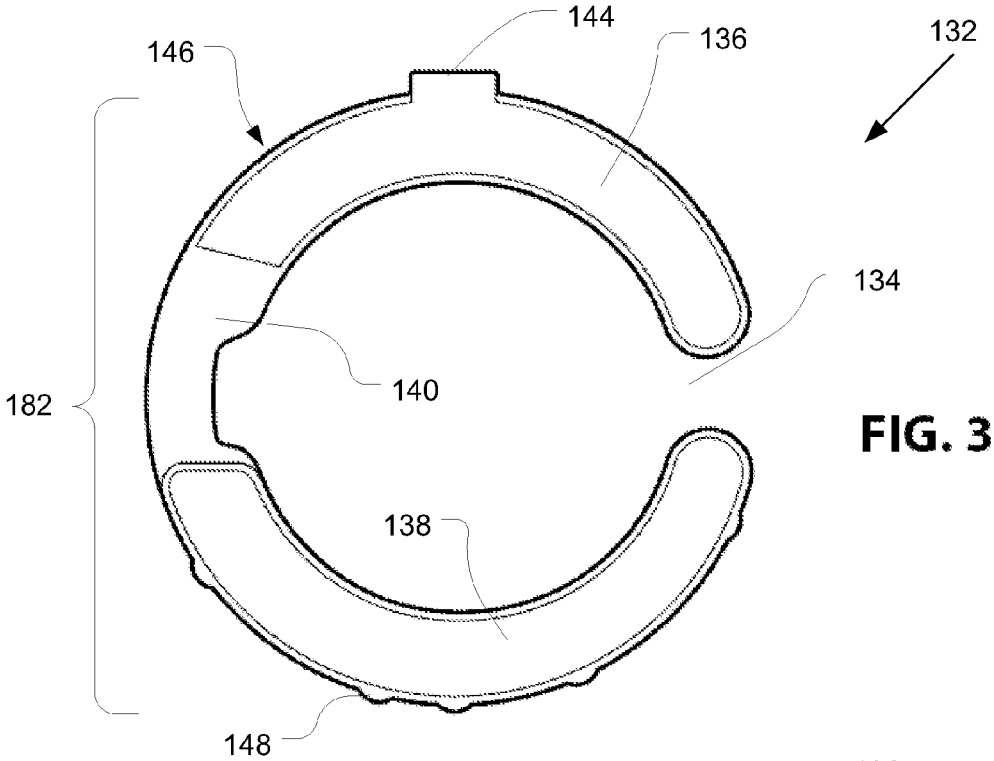
Figure 3D:
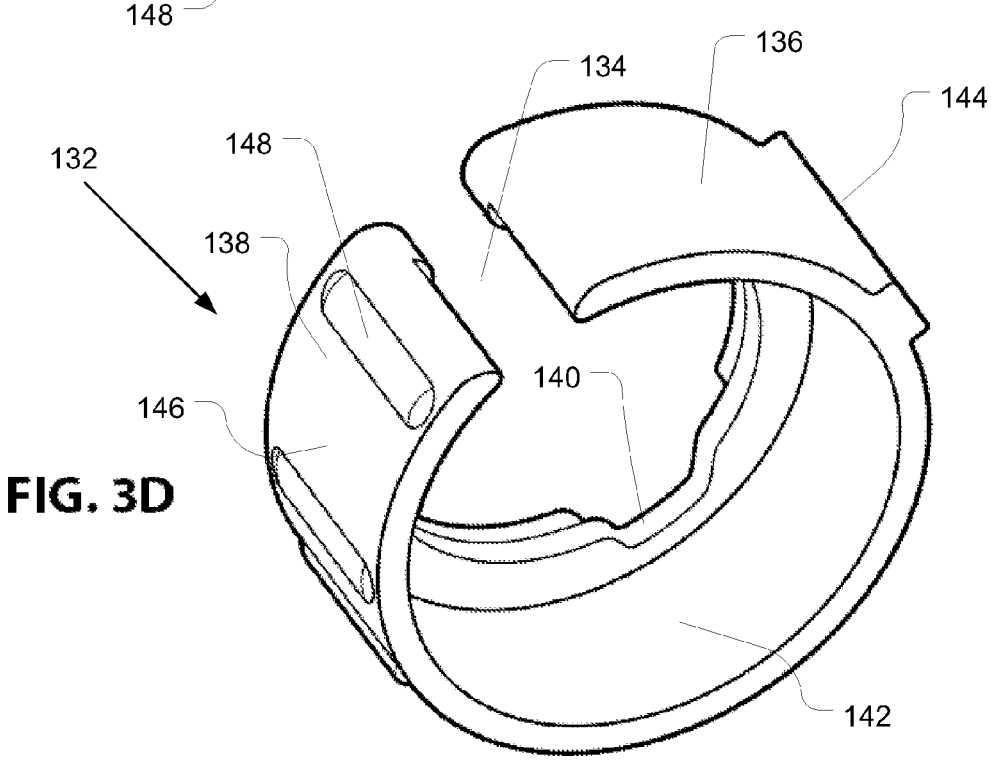

In various embodiments, the outer component 132 may have an axial length 180 (e.g., measured along the longitudinal axis of the flashlight 100), as best seen in FIG. 3A, that is relatively tall to provide a large surface area over which to press against the inside surface 150 of bezel 116. For example, the length 180 of the outer component 132 may be about one-quarter or more of an outer diameter 182 of the outer component 132, as best seen in FIG. 3C. Similarly, the length 180 of outer component 132 may be about one-quarter or more of an inner diameter 184 of the bezel 116 (as seen in FIG. 2A). Alternatively, in some embodiments, the length 180 of the outer component 132 may be about half of the outer diameter 182 of the outer component 132. In some embodiments, the length 180 may be longer than a width of gap 134, such as about two to about five times longer than the gap 134. In the depicted embodiment the length 180 is about four times longer than the gap 134.

In various embodiments, the locking assembly 128 may be adapted for use in flashlights having a wide range of diameters. The simple design and/or two-component construction of the locking-assembly 128 may allow the locking assembly 128 to be used in flashlights having a relatively small diameter.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A flashlight, comprising:

a body having a first end and defining a longitudinal axis of the flashlight;

a light assembly coupled to the first end of the body, the light assembly including a light source;

a bezel coupled to the first end of the body around the light assembly, the bezel including an inner surface and a lens configured to focus light from the light source, the bezel configured to be moved relative to the body along the longitudinal axis to adjust the focus of the light, and the bezel further configured to be rotated in a first direction to lock a current focus position of the bezel;

a locking assembly disposed within the bezel and configured to switch between an unlocked position and a locked position if the bezel is rotated with respect to the body, the locking assembly including:

a ring-shaped outer component having a gap and an outer surface, the ring-shaped outer component configured to rotate with the bezel; and an inner component coupled with the light assembly and configured to rotate with the body of the flashlight, the inner component including a nub configured to be disposed in the gap if the locking assembly is in the unlocked position, and to radially push the outer surface of the outer component against the inner surface of the bezel if the locking assembly is in the locked position.

2. The flashlight of claim 1, wherein the outer component further includes ridges on the outer surface of the outer component to hold the bezel in the current focus position if the locking assembly is in the locked position.

3. The flashlight of claim 2, wherein the bezel includes a slot on the inner surface of the bezel, and the outer component further includes:

a first curved wall having a guide member disposed in the slot to cause the outer component to rotate with the bezel; and a second curved wall opposite the gap from the first curved wall, the ridges being disposed on the second curved wall;

wherein the nub is configured to radially push on the second curved wall if the locking assembly is in the locked position.

4. The flashlight of claim 3, wherein the first curved wall and second curved wall are connected by a lip.

5. The flashlight of claim 4, wherein the inner component further includes a tab disposed above the lip between the first curved wall and the second curved wall to stop the locking assembly from rotating past the locked position in the first direction.

6. The flashlight of claim 1, wherein the bezel is further configured to be rotated with respect to the body in a second direction, opposite the first direction, to unlock the current focus position.

7. The flashlight of claim 1, wherein the light assembly includes a pedestal coupled to the light source, and wherein the pedestal is coupled to the first end of the base by a threaded portion, and wherein the locking assembly is coupled to the pedestal around the light source.

8. The flashlight of claim 1, wherein the outer component has a length in the longitudinal direction and a diameter, wherein the length is about one-quarter or more of the diameter.

9. The flashlight of claim 8, wherein the length is about one-half the diameter of the outer component.

10. The flashlight of claim 8, wherein the gap of the outer component has a width, and wherein the length of the outer component is greater than the width of the gap.

11. A flashlight, comprising:

a body having a first end and defining a longitudinal axis of the flashlight;

a light assembly coupled to the first end of the body, the light assembly including a light source;

a bezel coupled to the first end of the body around the light assembly, the bezel including an inner surface and a lens configured to focus light from the light source, the bezel configured to be moved relative to the body along the longitudinal axis to adjust the focus of the light, and the bezel further configured to be rotated in a first direction to lock a current focus position of the bezel;

a locking assembly disposed within the bezel and configured to switch between an unlocked position and a locked position if the bezel is rotated with respect to the body, the locking assembly including:

a ring-shaped outer component having a first curved wall and a second curved wall separated by a gap, the second curved wall having an outer surface, and the ring-shaped outer component configured to rotate with the bezel; and an inner component coupled with the light assembly and configured to rotate with the body of the flashlight, the inner component including a nub configured to be disposed in the gap if the locking assembly is in the unlocked position, and to radially push the outer surface of the second curved wall against the inner surface of the bezel if the locking assembly is in the locked position.

12. The flashlight of claim 11, wherein the outer component further includes ridges on the outer surface of the second curved wall to hold the bezel in the current focus position if the locking assembly is in the locked position.

13. The flashlight of claim 11, wherein the bezel includes a slot on the inner surface of the bezel, and the outer component further includes a guide member on the first curved wall and disposed in the slot of the bezel.

14. The flashlight of claim 11, wherein the first curved wall and second curved wall are connected by a lip, wherein the inner component further includes a tab disposed above the lip between the first curved wall and the second curved wall to stop the locking assembly from rotating past the locked position in the first direction.

15. The flashlight of claim 11, wherein the bezel is further configured to be rotated with respect to the body in a second direction, opposite the first direction, to unlock the current focus position.

16. The flashlight of claim 11, wherein the outer component has a length in the longitudinal direction and a diameter, wherein the length is about one-quarter or more of the diameter.

17. The flashlight of claim 16, wherein the gap of the outer component has a width, and wherein the length of the outer component is greater than the width of the gap.

18. A flashlight, comprising:

a body having a first end and defining a longitudinal axis of the flashlight;

a light assembly coupled to the first end of the body, the light assembly including a light source;

a bezel coupled to the first end of the body, the bezel including an inner surface and a lens configured to focus light from the light source, the bezel configured to be moved relative to the body along the longitudinal axis to adjust the focus of the light, and the bezel further configured to be rotated in a first direction to lock a current focus position of the bezel;

a locking assembly disposed within the bezel and configured to switch between an unlocked position and a locked position if the bezel is rotated with respect to the body, the locking assembly including:

a ring-shaped outer component having a first curved wall and a second curved wall separated by a gap, the second curved wall having an outer surface with a plurality of ridges, and the ring-shaped outer component configured to rotate with the bezel;

an inner component coupled with the light assembly and configured to rotate with the body of the flashlight, the inner component including a nub configured to be disposed in the gap if the locking assembly is in the unlocked position, and to radially push the outer surface of the second curved wall against the inner surface of the bezel if the locking assembly is in the locked position;

wherein the outer component has a length and a diameter, and wherein the length is at least one-quarter of the diameter.

19. The flashlight of claim 18, wherein the bezel includes a slot on the inner surface of the bezel, and the outer component further includes a guide member on the first curved wall and disposed in the slot of the bezel.

20. The flashlight of claim 18, wherein the first curved wall and second curved wall are connected by a lip, wherein the inner component further includes a tab disposed above the lip between the first curved wall and the second curved wall to stop the locking assembly from rotating past the locked position in the first direction.

21. A flashlight, comprising:

a body having a first end and defining a longitudinal axis of the flashlight;

a light assembly coupled to the first end of the body, the light assembly including a light source;

a bezel coupled to the first end of the body around the light assembly, the bezel including an inner surface and a lens configured to focus light from the light source, the bezel configured to be moved relative to the body along the longitudinal axis to adjust the focus of the light, and the bezel further configured to be rotated in a first direction to lock a current focus position of the bezel;

a locking assembly disposed within the bezel and configured to switch between an unlocked position and a locked position if the bezel is rotated with respect to the body, the locking assembly including:

a ring-shaped outer component having a gap and an outer surface adjacent the gap, the ring-shaped outer component configured to rotate with the bezel; and an inner component coupled with the light assembly and configured to rotate with the body of the flashlight, the inner component including a nub to radially push the outer surface of the outer component against the inner surface of the bezel if the locking assembly is in the locked position.

22. The flashlight of claim 21, wherein the outer component further includes ridges on the outer surface of the outer component to hold the bezel in the current focus position if the locking assembly is in the locked position.

23. The flashlight of claim 22, wherein the bezel includes a slot on the inner surface of the bezel, and the outer component further includes:

a first curved wall having a guide member disposed in the slot to cause the outer component to rotate with the bezel; and a second curved wall opposite the gap from the first curved wall, the ridges being disposed on the second curved wall;

wherein the nub is configured to radially push on the second curved wall if the locking assembly is in the locked position.

24. The flashlight of claim 23, wherein the first curved wall and second curved wall are connected by a lip.

25. The flashlight of claim 24, wherein the inner component further includes a tab disposed above the lip between the first curved wall and the second curved wall to stop the locking assembly from rotating past the locked position in the first direction.

26. The flashlight of claim 21, wherein the bezel is further configured to be rotated with respect to the body in a second direction, opposite the first direction, to unlock the current focus position.

27. The flashlight of claim 21, wherein the outer component has a length in the longitudinal direction and a diameter, wherein the length is about one-quarter or more of the diameter.

28. The flashlight of claim 27, wherein the length is about one-half the diameter of the outer component.

29. The flashlight of claim 27, wherein the gap of the outer component has a width, and wherein the length of the outer component is greater than the width of the gap.

* * * * *